US009187301B2

(12) United States Patent
Watson et al.

(10) Patent No.: US 9,187,301 B2
(45) Date of Patent: Nov. 17, 2015

(54) SELF-PROPEL ACCESSORY

(71) Applicant: JLG Industries, Inc., McConnellsburg, PA (US)

(72) Inventors: Jason James Watson, Matraville (AU); Geoffrey George Campbell, Kensington (AU)

(73) Assignee: JLG Industries, Inc., McConnellsburg, PA (US)

( * ) Notice: Subject to any disclaimer, the term of this patent is extended or adjusted under 35 U.S.C. 154(b) by 165 days.

(21) Appl. No.: 13/867,742

(22) Filed: Apr. 22, 2013

(65) Prior Publication Data

US 2014/0311825 A1 Oct. 23, 2014

(51) Int. Cl.
*B66F 11/04* (2006.01)

(52) U.S. Cl.
CPC ..... *B66F 11/04* (2013.01)

(58) Field of Classification Search
CPC ..... B66F 11/01; B66F 11/044; E04G 1/22; A01D 46/20
USPC ..... 182/148, 141, 63.1; 180/209, 210, 211, 180/213, 214; 280/43, 43.1, 43.14, 43.24
See application file for complete search history.

(56) References Cited

U.S. PATENT DOCUMENTS

| | | | | |
|---|---|---|---|---|
| 1,051,247 | A * | 1/1913 | McLendon | 188/7 |
| 3,749,201 | A * | 7/1973 | Clarke | 187/243 |
| 5,116,264 | A * | 5/1992 | Wiederrich et al. | 108/23 |
| 5,337,858 | A * | 8/1994 | Neubauer et al. | 182/148 |
| 5,875,869 | A * | 3/1999 | Busuttil et al. | 182/69.6 |
| 6,889,784 | B2 * | 5/2005 | Troll | 180/13 |
| 6,938,711 | B2 * | 9/2005 | Kime et al. | 180/11 |
| 7,004,284 | B2 * | 2/2006 | Chick | 182/16 |
| D570,071 | S | 5/2008 | Campbell et al. | |
| 8,371,404 | B2 * | 2/2013 | Boeckler | 180/65.1 |
| 8,434,592 | B1 * | 5/2013 | Young | 182/12 |
| 8,454,032 | B2 * | 6/2013 | Havener | 280/32.7 |
| D714,010 | S * | 9/2014 | Hurst | D34/17 |
| 2002/0084116 | A1 * | 7/2002 | Ruschke et al. | 180/11 |
| 2004/0144586 | A1 | 7/2004 | Trott | |

(Continued)

FOREIGN PATENT DOCUMENTS

| | | |
|---|---|---|
| EP | 0 557 685 | 9/1993 |
| JP | 63-66945 | 5/1988 |

(Continued)

OTHER PUBLICATIONS

European Search Report dated Jun. 18, 2014 issued in European Patent Application No. 14165508.4, 4 pp.

(Continued)

*Primary Examiner* — Alvin Chin-Shue
*Assistant Examiner* — Kristine Florio
(74) *Attorney, Agent, or Firm* — Nixon & Vanderhye P.C.

(57) ABSTRACT

A self-propel accessory provides an easily attachable optional drive function for a platform device. The platform device is supported by a device frame including a wheel at a rear end and a post at a front end. The self-propel accessory includes an accessory frame attachable to the device frame via a bracket, a driving wheel connected to the accessory frame, a motor operatively coupled with the driving wheel, and a handle connected to the accessory frame. The accessory frame is pivotable between a disengaged position and an engaged position, and a weight of the platform device biases the accessory frame toward the disengaged position.

22 Claims, 5 Drawing Sheets

(56) References Cited

U.S. PATENT DOCUMENTS

| | | | | |
|---|---|---|---|---|
| 2008/0314690 | A1 | 12/2008 | Campbell et al. | |
| 2011/0000731 | A1* | 1/2011 | Boeckler | 180/220 |
| 2012/0043158 | A1* | 2/2012 | Campbell et al. | 182/69.4 |

FOREIGN PATENT DOCUMENTS

| | | |
|---|---|---|
| JP | 3-3233 | 1/1991 |
| JP | 6-6153 | 2/1994 |
| JP | 6-54692 | 7/1994 |
| WO | WO 2012/024378 | 2/2012 |

OTHER PUBLICATIONS

Japanese Office Action dated Jan. 27, 2015 issued in Japanese Patent Application No. 2014-087908 and English Translation, 5 pp.

* cited by examiner

SELF-PROPEL ACCESSORY

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The invention relates to a self-propel accessory and, more particularly, to a self-propel accessory provided for a platform device, where the platform is supported by a device frame including a wheel at a rear end and a post at a front end. The self-propel accessory includes a driving wheel that, when engaged, lifts the device frame post from a support position to enable a controlled drive with the accessory wheel and the frame device wheel.

A portable mast lift has been developed as an alternative to a conventional ladder. The mast lift includes a platform that is raised and lowered on a mast using a rotary power source such as a hand-held drill or a dedicated power pack (see, for example, U.S. Published Patent Application No. 2008/0314690 and U.S. Pat. No. D570,071).

The portable mast lift is primarily made portable by virtue of the low material weight of the device. The supporting structure includes a device frame with a wheel at a rear end and a non-wheel bracket or post at a front end. The "post" could be a wheel or other suitable supporting structure. When it is desired to transport the device, with the platform in the lowered position, the operator can tilt the device back on the wheel, thereby lifting the post from the ground. With the post off the ground, the device is easily manipulated on the device wheel (not unlike a hand truck).

It would be desirable to provide an easily attachable self-propel accessory that is cooperable with such a device to facilitate transport of the device. Ideally, the accessory would enable the operator to transport the device without requiring the operator to leave the platform.

BRIEF SUMMARY OF THE INVENTION

A self-propel accessory is particularly suited for a platform device including a device frame with a wheel at a rear end and a non-wheel bracket or post end at a front end. Without the self-propel device, in order to move the platform device from one working location to another, the operator will tip the device back on the wheel, thereby lifting the post off the ground. The self-propel accessory of the described embodiment can be easily attached to the device frame and includes a driven wheel that is selectively engageable with the ground to provide an auto-drive accessory for the platform device.

In an exemplary embodiment, a self-propel accessory is provided for a platform device. The platform device is supported by a device frame including a wheel at a rear end and a post at a front end. The self-propel accessory includes an accessory frame attachable to the device frame via a bracket, a driving wheel connected to the accessory frame, a motor operatively coupled with the driving wheel, and a handle connected to the accessory frame. The accessory frame is pivotable between a disengaged position and an engaged position, and a weight of the platform device biases the accessory frame toward the disengaged position.

The bracket may be pivotally securable to the device frame adjacent the front end of the device frame, where the accessory frame is pivotable from the disengaged position to the engaged position via the handle. In this context, the driving wheel may be positioned via the bracket on an underside of the accessory frame, and the driving wheel may be sized and positioned such that when the accessory frame is pivoted to the engaged position, the driving wheel is urged into a ground surface.

In one arrangement, the driving wheel includes a wheel frame that is pivotable relative to the bracket. In this context, the handle may be displaceable to selectively pivot the wheel frame relative to the bracket to thereby effect steering. The accessory may additionally include a linkage mechanism connected between the handle and the wheel frame. Alternatively, the accessory frame may be pivotable relative to the bracket, and the wheel frame may be fixed to the accessory frame such that steering is effected by displacing the accessory frame relative to the bracket. In this arrangement, two handles may be connected to opposite ends of the accessory frame.

The driving wheel may alternatively include a pivot pin fixed to the wheel frame and extending through an opening in the bracket. The accessory frame is secured to the pivot pin on a side of the bracket opposite from the wheel frame. In this context, the accessory may include two handles connected to the accessory frame and a twist throttle that effects steering of the driving wheel based on a relative position of the two handles.

The accessory may additionally include a battery pack connected to the motor. The driving wheel and the motor may be coupled via a hub motor. The accessory may additionally include a cordless tool battery connected to the motor.

In another exemplary embodiment, a mast lift includes a device frame including a wheel at a rear end and a post at a front end, a mast coupled with the device frame, a platform connected to the mast and movable on the mast between a lowered position and a raised position, and the self-propel accessory selectively attachable to the device frame. Preferably, the self-propel accessory is independent and portable such that the accessory can be carried by a single person.

In the engaged position, the driving wheel may be disposed in a position lower than in the disengaged position. In the engaged position, the driving wheel may be positioned relative to the device frame such that the self-propel accessory lifts the post at the front end of the device frame off of a supporting surface.

In yet another exemplary embodiment, a self-propel accessory includes a connecting bracket, an accessory frame secured to the connecting bracket, a driving wheel connected to the accessory frame, a motor operatively coupled with the driving wheel, and a handle connected to the accessory frame. The accessory frame is pivotable via the handle between a disengaged position and an engaged position.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
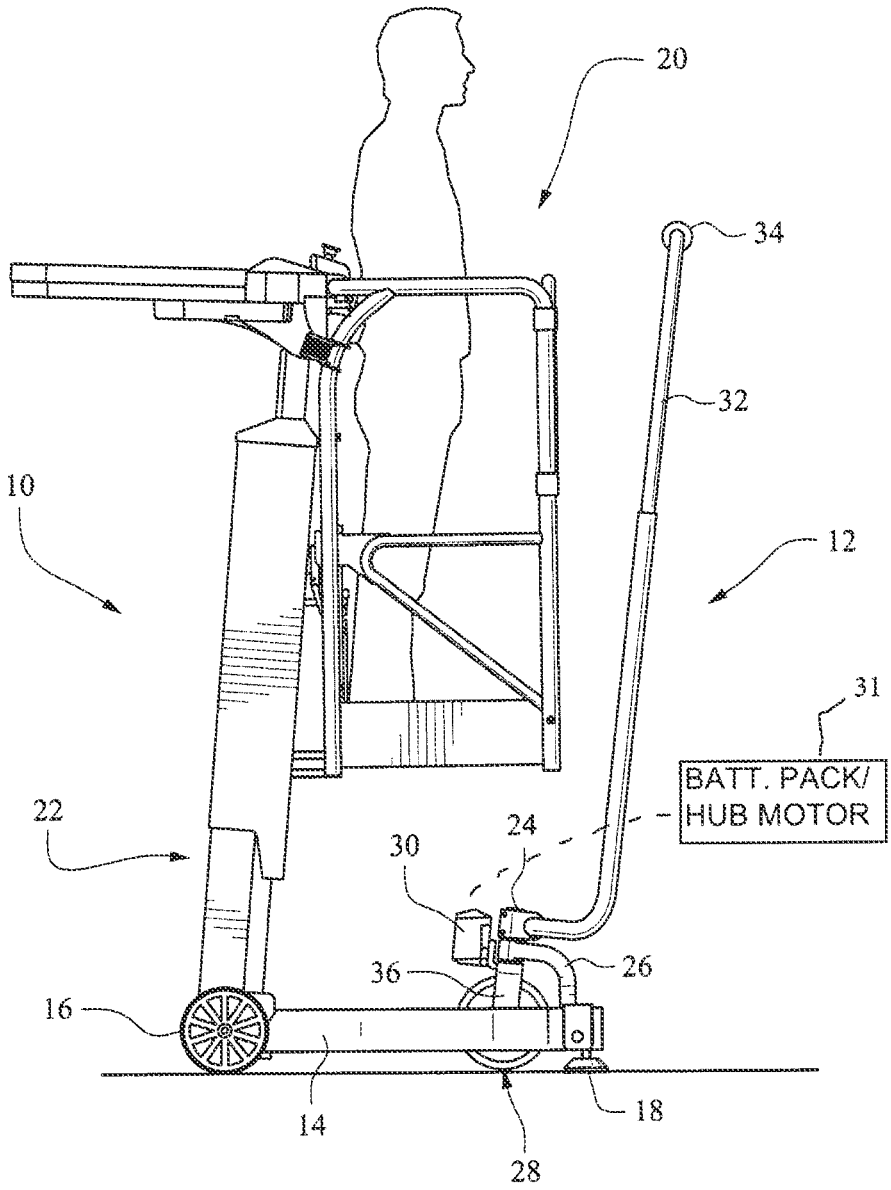
FIG. 1 is a side view of an exemplary platform device including a self-propel accessory in a disengaged position.

FIG. 1 shows an exemplary platform device 10 including a self-propel accessory 12. The platform device includes a device frame 14 with a wheel 16 at a rear end and a post 18 at a front end. The "post" could be a wheel or other suitable supporting structure. In the exemplary platform device 10, a platform 20 is movable on a mast 22 between a lowered position and a raised position.

The self-propel accessory includes an accessory frame 24 attachable to the device frame 14 via a bracket 26. A driving wheel 28 is connected to the frame 24 via or through the bracket 26. A motor 30, which is preferably powered by a cordless tool battery or battery pack 31, is operatively coupled with the driving wheel 28. The motor may be comprised by the battery pack 31 via a huh motor, i.e., the wheel is a motor with tread. A handle 32 is connected to the accessory frame 24. Driving controls 34 are provided at an end of the handle 32.

Figure 2:
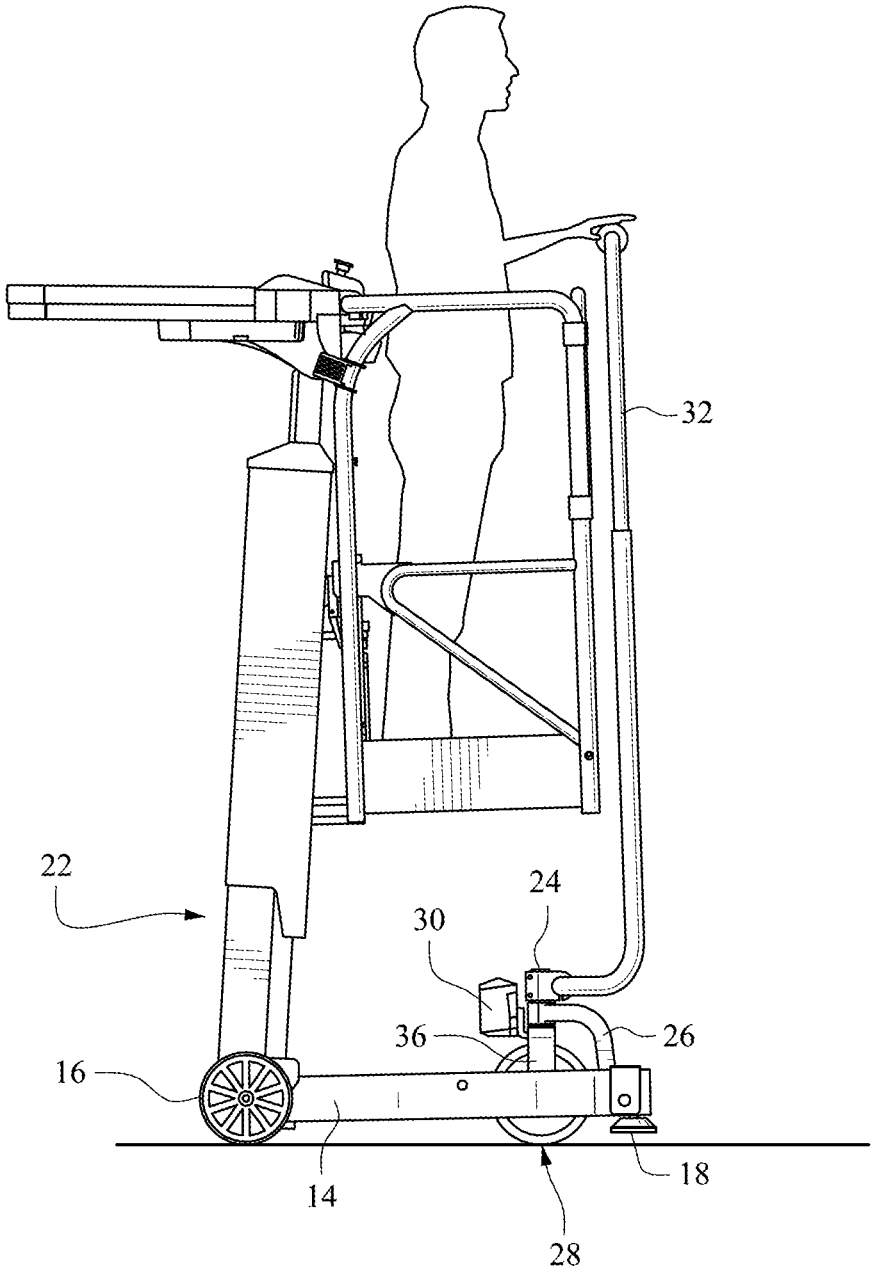
FIG. 2 shows the platform device with the self-propel accessory in an engaged position.

In a preferred construction, the accessory frame 24 along with the bracket 26 and wheel 28 are pivotable between a disengaged position (shown in FIG. 1) and an engaged position (shown in FIG. 2). That is, the driving wheel 28 is positioned via the bracket 26 on an underside of the accessory frame 24. The driving wheel 28 is sized and positioned such that when the accessory frame 24 is pivoted to the engaged position, the driving wheel 28 is urged into a ground surface. With reference to FIG. 2, the operator can selectively pivot the self-propel accessory from the disengaged position to the engaged position by pulling back on the handle 32. As shown in FIG. 2, as the self-propel accessory is pivoted into the engaged position, the driving wheel 28 lifts the post 18 off the ground. As such, the device frame is then supported on the wheel 16 of the frame device and the driving wheel 28 of the self-propel accessory. In this configuration, when the driving wheel 28 is activated, the platform device can be driven by the operator.

Figure 5:
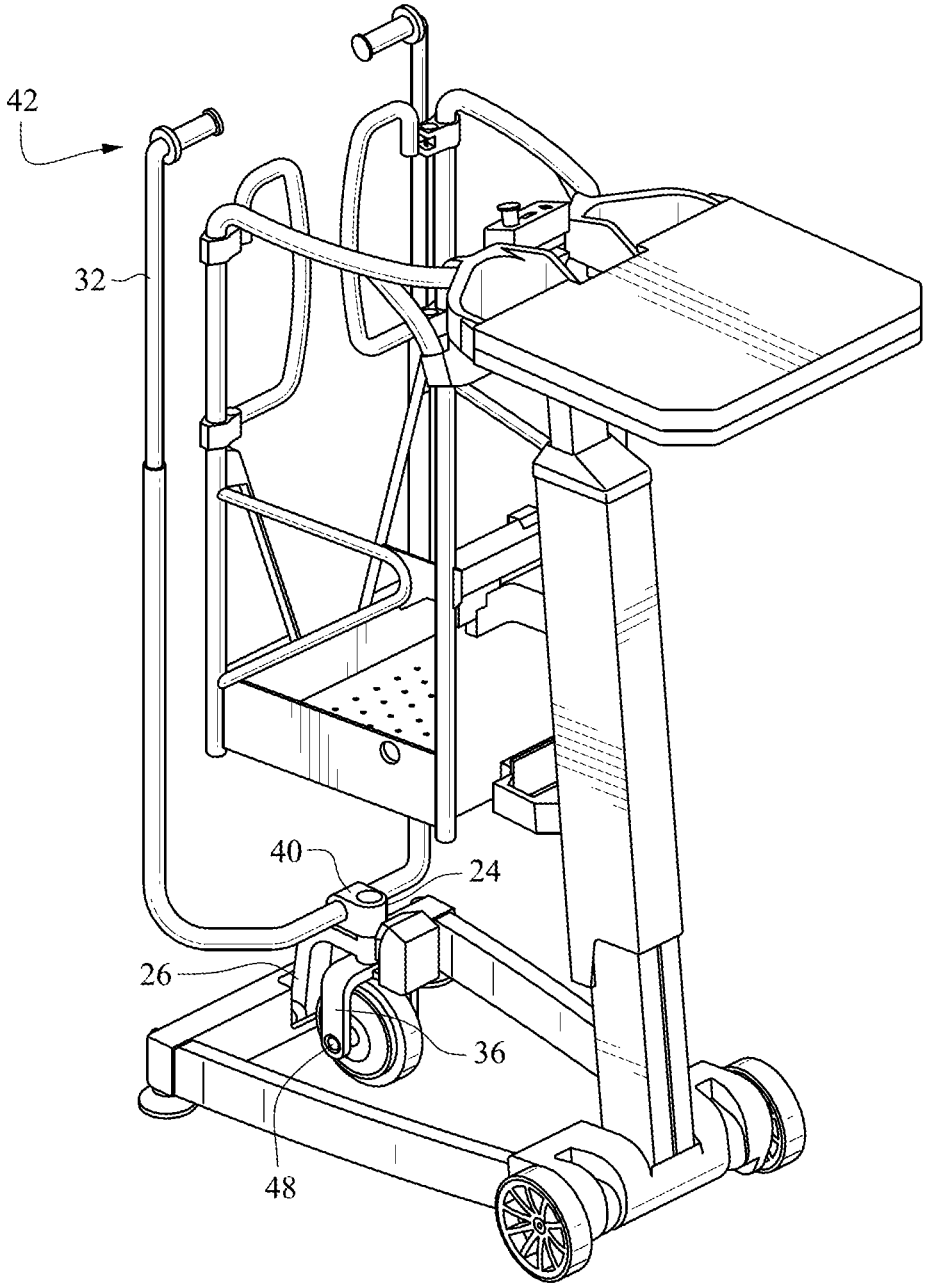
FIG. 5 is a perspective view of an alternative version of the self-propel accessory.

The driving wheel 28 includes a wheel frame 36 that is rotatable relative to the bracket 26. The driving wheel 28 is preferably connected to the wheel frame 36 via a suitable axle 48 (FIG. 5). The handle 32 is displaceable to selectively pivot/rotate the wheel frame 36 relative to the bracket 26 to thereby effect steering.

Figure 3:
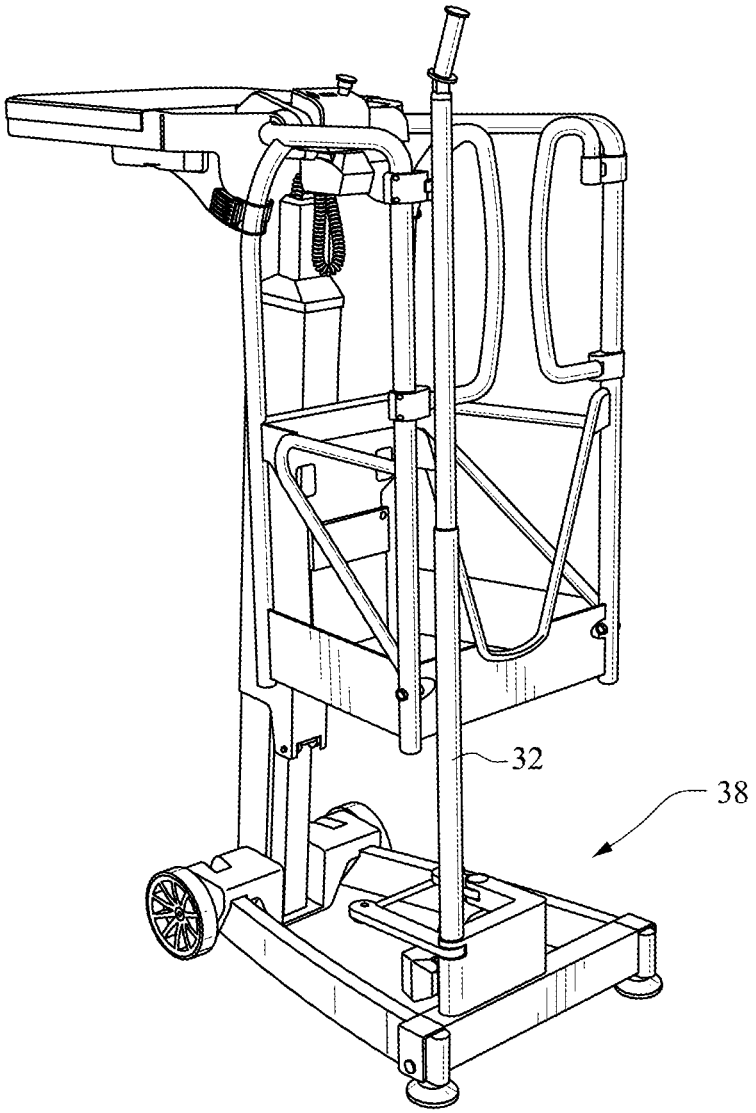
FIG. 3 is a perspective view of the system showing a single hand operation.
Figure 4:
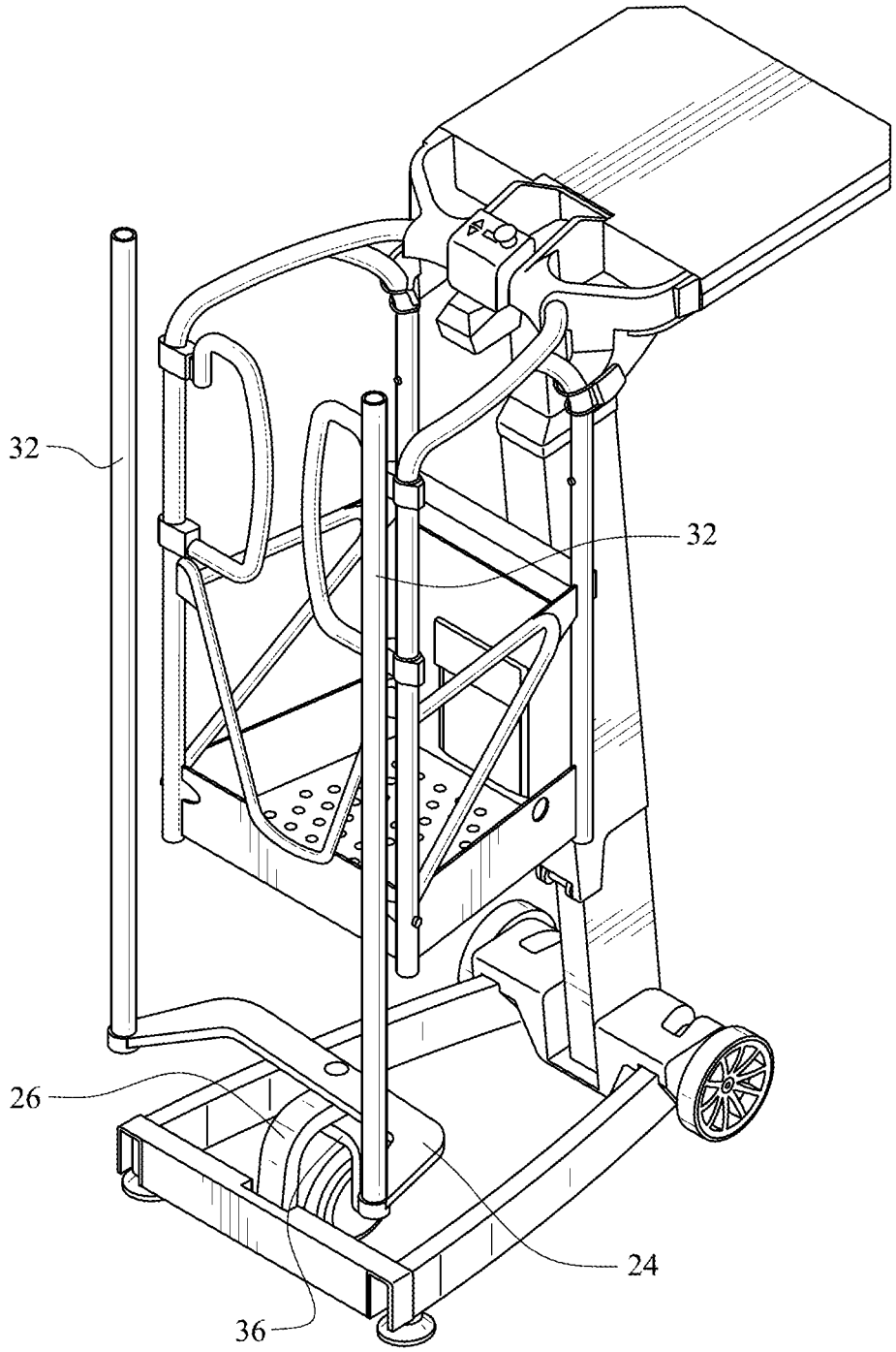
FIG. 4 is a perspective view of the system showing a two-hand operation.

Various constructions can be used to effect steering by the handle 32. In one arrangement, as shown in FIG. 3, a linkage mechanism 38 is connected between the handle 32 and the wheel frame 36. The linkage mechanism 38 shown in FIG. 3 provides for steering with a single hand. Alternatively, as shown in FIG. 4, the accessory frame 24 may be pivotable relative to the bracket 26, and the wheel frame 36 may be fixed to the accessory frame 24 such that steering is effected by displacing the accessory frame 24 relative to the bracket 26. In this embodiment, two handles 32 are shown attached to opposite ends of the accessory frame 24 for two-hand operation and steering.

With reference to FIG. 5, the driving wheel 28 may include a pivot pin 40 fixed to the wheel frame 36 and extending through an opening in the bracket 26. In this embodiment, the accessory frame 24 is secured to the pivot pin 40 on a side of the bracket 26 opposite from the wheel frame 36. In the embodiment shown in FIG. 5, steering is effected by two handles 32 including a twist throttle 42 that effects steering of the driving wheel 28 based on a relative position of the two handles 32. Although the twist throttle 42 is shown, any trigger, switch or control circuit could be used to control throttle/drive.

A size of the handles 32 may be adjustable via telescoping parts or the like. Preferably, however, the length of the handles 32 is limited so that the platform must be lowered to a certain extent before enabling the operator to reach the handles. With the platform in its maximum raised position, it may be unsafe to drive the platform device. That is, the height of drive can be controlled via the length of the handles to ensure that stability is maintained when driving the machine.

It is preferable that the self-propel accessory is not in any manner electrically interlocked with the lift mechanism for raising and lowering the platform. Additionally, it is desirable that the self-propel accessory is easily attached and detached, such as via a "clip-on" system so that the operator can selectively install or remove the accessory on the machine.

Activation of the motor may be effected by a simple power tool electrical switch, although other activators may be used, and the invention is not necessarily meant to be limited to the described application.

The accessory is inherently safe wherein if the user is not applying an active force to the lever to engage the self-propel accessory, the driving wheel is disengaged from the ground by the natural weight of the user and machine. That is a weight of the platform device (and the user if on the platform) biases the accessory frame 24 towards its disengaged position.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A self-propel accessory for a platform device, where the platform device is supported by a device frame including a wheel at a rear end and a post at a front end, the self-propel accessory comprising:

an accessory frame attached to the device frame via a bracket;

a driving wheel connected to the accessory frame;

a motor operatively coupled with the driving wheel; and a handle connected to the accessory frame, wherein the driving wheel is positioned between the wheel and the post of the platform device, wherein the accessory frame is pivotable between a disengaged position and an engaged position, and wherein a weight of the platform device biases the accessory frame toward the disengaged position, wherein the handle is positioned in a forward position relative to a driving direction forward of the driving wheel in the disengaged position such that the accessory frame is pivotable from the disengaged position to the engaged position by displacing the handle backward from the forward position.

2. A self-propel accessory according to claim 1, wherein the bracket is pivotally securable to the device frame adjacent the front end of the device frame.

3. A self-propel accessory according to claim 2, wherein the driving wheel is positioned via the bracket on an underside of the accessory frame, and wherein the driving wheel is sized and positioned such that when the accessory frame is pivoted to the engaged position, the driving wheel is urged into a ground surface.

4. A self-propel accessory according to claim 1, wherein the driving wheel comprises a wheel frame that is pivotable relative to the bracket.

5. A self-propel accessory according to claim 4, wherein the handle is displaceable to selectively pivot the wheel frame relative to the bracket to thereby effect steering.

6. A self-propel accessory according to claim 5, further comprising a linkage mechanism connected between the handle and the wheel frame.

7. A self-propel accessory according to claim 5, wherein the accessory frame is pivotable relative to the bracket and the wheel frame is fixed to the accessory frame such that steering is effected by displacing the accessory frame relative to the bracket.

8. A self-propel accessory according to claim 7, comprising two handles connected to opposite ends of the accessory frame.

9. A self-propel accessory according to claim 4, wherein the driving wheel further comprises a pivot pin fixed to the wheel frame and extending through an opening in the bracket, and wherein the accessory frame is secured to the pivot pin on a side of the bracket opposite from the wheel frame.

10. A self-propel accessory according to claim 9, comprising two handles connected to the accessory frame and a twist throttle that effects steering of the driving wheel based on a relative position of the two handles.

11. A self-propel accessory according to claim 1, further comprising a battery pack connected to the motor.

12. A self-propel accessory according to claim 1, wherein the driving wheel and the motor comprise a hub motor wheel.

13. A self-propel accessory according to claim 1, further comprising a cordless tool battery connected to the motor.

14. A mast lift comprising:

a device frame including a wheel at a rear end and a post at a front end, the wheel and the post supporting the device frame;

a mast coupled with the device frame;

a platform connected to the mast and movable on the mast between a lowered position and a raised position; and a self-propel accessory selectively attached to the device frame, the self-propel accessory including:

an accessory frame attached to the device frame via a bracket, a driving wheel connected to the accessory frame, a motor operatively coupled with the driving wheel, and a handle connected to the accessory frame, wherein the driving wheel is positioned between the wheel and the post of the platform device, wherein the accessory frame is pivotable between a disengaged position and an engaged position, and wherein a weight of the device frame, the mast and the platform biases the accessory frame toward the disengaged position, wherein the handle is positioned in a forward position relative to a driving direction forward of the driving wheel in the disengaged position such that the accessory frame is pivotable from the disengaged position to the engaged position by displacing the handle backward from the forward position.

15. A mast lift according to claim 14, wherein the bracket is pivotally secured to the device frame adjacent the front end of the device frame.

16. A mast lift according to claim 15, wherein the driving wheel is positioned via the bracket on an underside of the accessory frame, and wherein the driving wheel is sized and positioned such that when the accessory frame is pivoted to the engaged position, the driving wheel is urged into a ground surface.

17. A mast lift according to claim 14, wherein the driving wheel comprises a wheel frame that is pivotable relative to the bracket.

18. A mast lift according to claim 17, wherein the handle is displaceable to selectively pivot the wheel frame relative to the bracket to thereby effect steering.

19. A mast lift according to claim 14, further comprising a battery pack connected to the motor.

20. A mast lift according to claim 14, wherein in the engaged position, the driving wheel is disposed in a position lower than in the disengaged position.

21. A mast lift according to claim 20, wherein in the engaged position, the driving wheel is positioned relative to the device frame such that the self-propel accessory lifts the post at the front end of the device frame off of a supporting surface.

22. A mast lift according to claim 14, wherein the self-propel accessory is independent and portable such that the accessory can be carried by a single person.

* * * * *